US006585454B1

(12) United States Patent
Fisher et al.

(10) Patent No.: US 6,585,454 B1
(45) Date of Patent: Jul. 1, 2003

(54) APPARATUS AND METHOD FOR ANCHORING A DOCK

(76) Inventors: John D. Fisher, 4011 Manhatten Ave., #363, Tampa, FL (US) 33611; Wayne A. Smith, 2700 Centerview Pl., Brandon, FL (US) 33511

( * ) Notice: Subject to any disclaimer, the term of this patent is extended or adjusted under 35 U.S.C. 154(b) by 0 days.

(21) Appl. No.: 09/679,253

(22) Filed: Oct. 4, 2000

(51) Int. Cl.[7] ..... E02B 3/20
(52) U.S. Cl. ..... 405/218; 405/219; 405/203
(58) Field of Search ..... 405/218, 219, 405/220, 221; 52/165, 162, 163; 248/530; 312/351.3, 351.1; 108/42

(56) References Cited

U.S. PATENT DOCUMENTS 2,948,121 A * 8/1960 Karst ..... 405/220
3,100,968 A * 8/1963 Bourdon ..... 405/221
3,345,825 A * 10/1967 Parker ..... 405/218
4,099,354 A 7/1978 DePirro
4,123,912 A * 11/1978 Meldrum ..... 405/220
4,455,795 A 6/1984 Cole
4,505,619 A * 3/1985 Sargent ..... 405/220
5,046,897 A * 9/1991 Ray ..... 405/221
5,074,716 A 12/1991 Hollowell et al.
5,788,416 A 8/1998 Wolgamot
5,901,525 A 5/1999 Doeringer et al.

* cited by examiner

*Primary Examiner*—Heather Shackelford
*Assistant Examiner*—Frederick L. Lagman
(74) *Attorney, Agent, or Firm*—David Kiewit

(57) ABSTRACT

An anchoring arrangement is provided for anchoring a dock leg to a bottom of a body of water. A base plate has a lumber or timber receiver on its top surface and has three or more anchor legs that are attached to the base plate and that extend downwardly. At least one of the anchor legs preferably has a fluke pivotally attached to it so that when the anchor leg is pushed downwardly into a bottom of a body of water the fluke pivots into contact with the anchor leg. A subsequent attempt to pull the anchor leg upward causes the fluke to pivot into an extended position in which it provides additional resistance to the upward motion of the anchoring leg. Most small docks have legs made of conventional lumber or timbers large enough to provide a buoyant force adequate to support thsi metal anchoring apparatus. One can thus attach the anchoring apparatus to a dock leg, tow the dock leg to wherever it is to be installed, turn it into a vertical orientation, and thrust the anchoring apparatus into the bottom of the body of water.

8 Claims, 2 Drawing Sheets

APPARATUS AND METHOD FOR ANCHORING A DOCK

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The invention relates to anchoring or affixing pilings to a bottom of a body of water, and more specifically relates to arrangements for affixing ones of a plurality of dock legs used to support a dock.

2. Background Information

Generally speaking, people have been embedding, driving, anchoring, or otherwise supporting a piling, post or similar structural member in the ground or in a bottom of a body of water for many generations. Among the voluminous patent art in this area, the following references appear relevant:

- U.S. Pat. No. 5,901,525, in which Doeringer et al. describe a column support comprising a lumber receiver having a base plate with anchoring legs. Fixed portions of the anchoring legs extend radially outwardly from a center of the receiver so as to better retain the column support in a concrete body that is cast over the legs.
- U.S. Pat. No. 5,788,416, to Wolgamot, who discloses an approach to making a dock supported on a plurality of metal legs. A flat foot-plate is welded to the bottom of each of the legs of Wolgamot's dock. The dock is supported on the bottom of a body of water by the plurality of foot-plates. Wolgamot does not teach the use of penetrating members extending below his foot-plates.
- U.S. Pat. No. 5,074,716, wherein Holowell et al. show an oil rig leg support having a base plate attached to a plurality of piling sleeves through which pilings are driven to anchor the leg to the bottom of a body of water. Holowell et al.'s anchoring structure is designed to be sufficiently buoyant that it can be towed to an installation site.
- U.S. Pat. No. 4,099,354, wherein DePierro shows several embodiments of piling receivers. One of these comprises anchoring legs. Each leg has a "stop plate" extending radially outward from its axis. DePierro's stop plates are fixed with respect to their associated anchoring legs. DePierro's stop plates do not penetrate the earth.

BRIEF SUMMARY OF THE INVENTION

A preferred embodiment of the invention provides apparatus for anchoring a dock leg to a bottom of a body of water. The preferred apparatus comprises a base plate having a lumber or timber receiver on its top surface and having three or more anchor legs attached to the base plate in a spaced-apart arrangement and extending downwardly from the base plate. At least one of the anchor legs preferably has a fluke pivotally attached to it so that when the anchor leg is pushed downwardly into a bottom of a body of water the fluke pivots into contact with the anchor leg. Any subsequent attempt to pull the anchor leg upwardly would cause the fluke to pivot into an extended position in which it provides additional resistance to the upward motion of the anchoring leg.

The invention provides a method of anchoring buoyant dock legs that is a significant improvement over the prior art. Most small docks have legs made of conventional lumber or timbers large enough to provide a buoyant force adequate to support a metal anchoring apparatus of the invention. One can thus attach the anchoring apparatus of the invention to a dock leg, tow the dock leg to wherever it is to be installed, turn it into a vertical orientation, and thrust the anchoring apparatus into the bottom of the body of water.

It is thus an object of the invention to provide dock leg anchoring apparatus light enough that a wooden dock leg having the anchoring apparatus attached to an end thereof forms a buoyant assembly. Moreover, this apparatus is tenacious enough when implanted in a bottom of a body of water that it resists an upward pull created by the buoyancy of the wood.

It is an additional object of the invention to provide a dock leg anchoring apparatus adapted to be emplaced so that a base plate portion of the apparatus rests on a bottom of a body of water and resists loads tending to push the dock leg too deeply into the bottom. As noted above, preferred embodiments of the invention comprise pivotally movable flukes attached to one or more of the anchoring legs. Each of these flukes is arranged to fold against its respective leg when that leg is pushed into the bottom of the body of water, and to pivot away from the leg so as to resist a force in the opposite direction. Hence, the anchoring apparatus of the invention is intended to resist forces in either direction along a vertical axis after the anchoring apparatus has been thrust sufficiently far into the bottom that a bottom surface of the base plate bears on the bottom of the body of water.

Although it is believed that the foregoing recital of features and advantages may be of use to one who is skilled in the art and who wishes to learn how to practice the invention, it will be recognized that the foregoing recital is not intended to list all of the features and advantages, Moreover, it may be noted that various embodiments of the invention may provide various combinations of the hereinbefore recited features and advantages of the invention, and that less than all of the recited features and advantages may be provided by some embodiments.

DETAILED DESCRIPTION OF THE INVENTION

Figure 1:
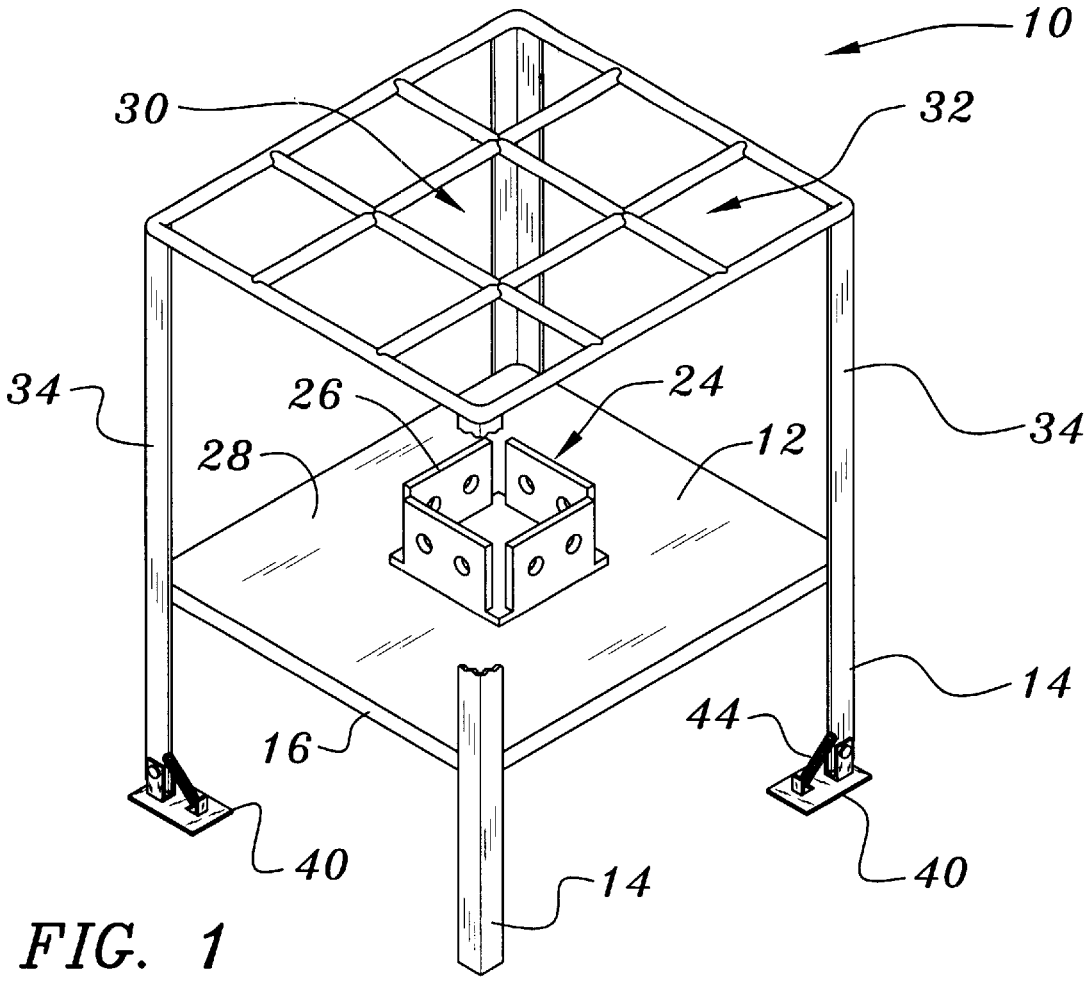
FIG. 1 is an elevational view of a preferred embodiment of the invention
Figure 4:
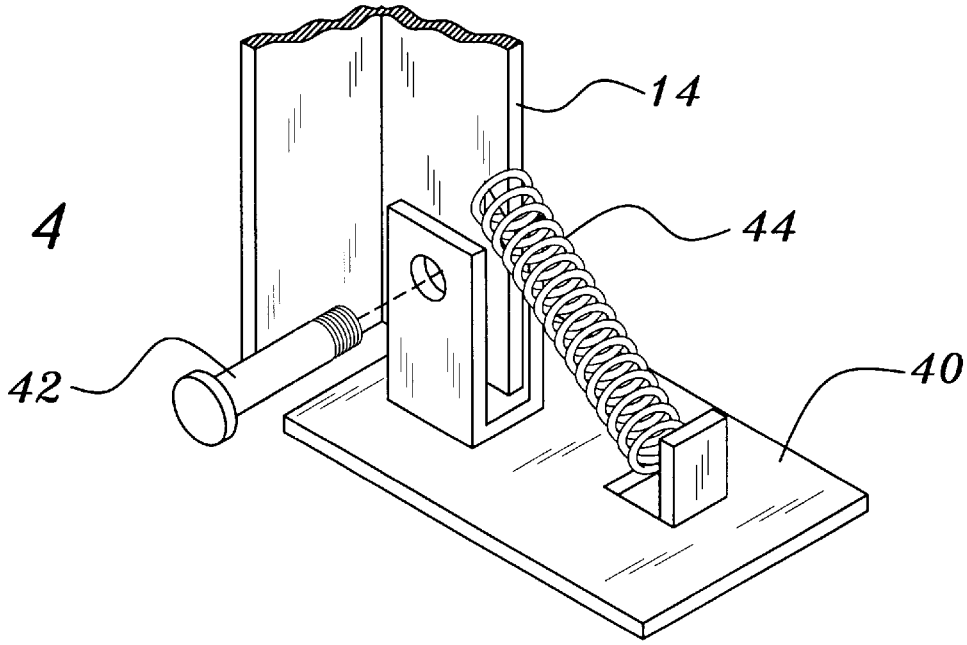
FIG. 4 is a detailed view of a preferred leg fluke.

A preferred anchoring apparatus 10 of the invention comprises a base plate 12 having a plurality of anchoring legs 14 spaced out along its periphery 16. In a preferred embodiment depicted in FIG. 1, the base plate 12 is square or rectangular and the anchoring legs 14 are attached to it at its four corners. Those skilled in the mechanical arts will appreciate that more or fewer anchoring legs could be used and that three or more anchoring points would often be used in attaching a first planar member, such as the base plate 12, to a second generally planar member, such as a bottom 18 of a body of water 20.

Figure 2:
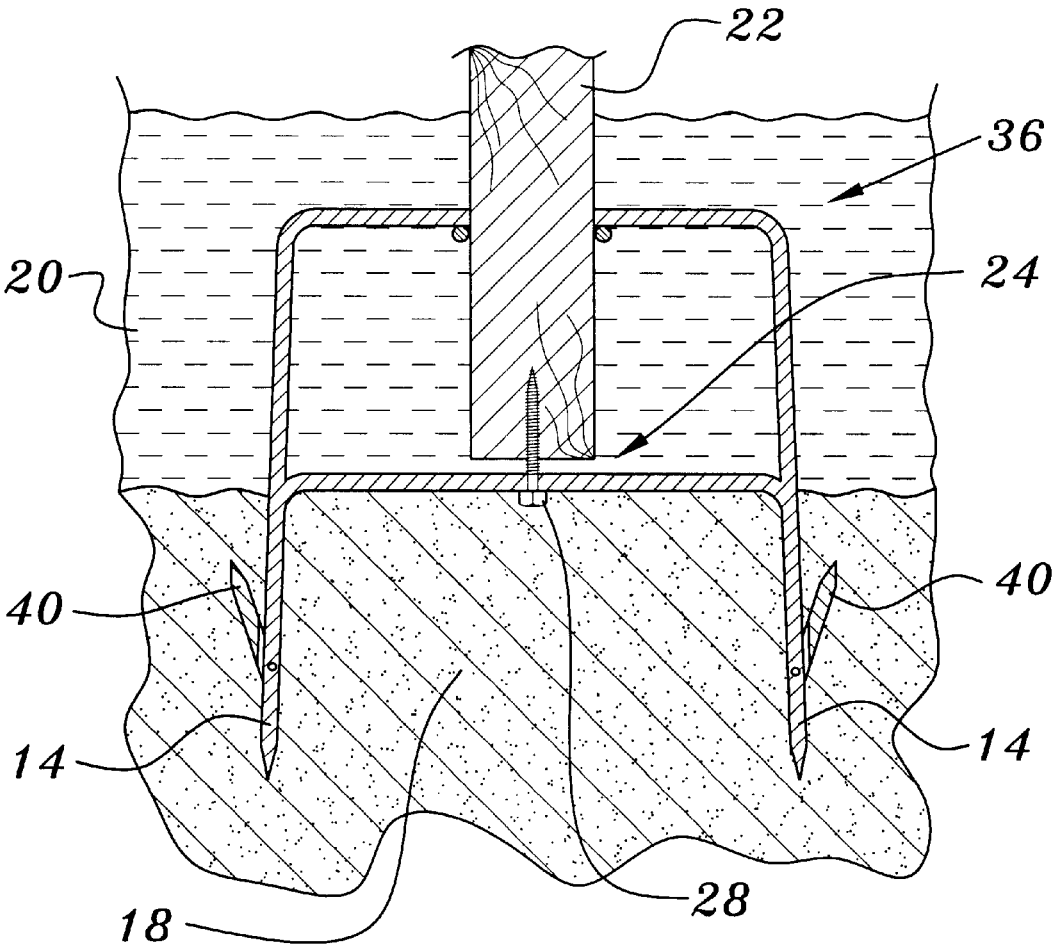
FIG. 2 is a axial cross sectional view of a second embodiment of the invention anchoring a dock leg to a bottom of a body of water.
Figure 3:
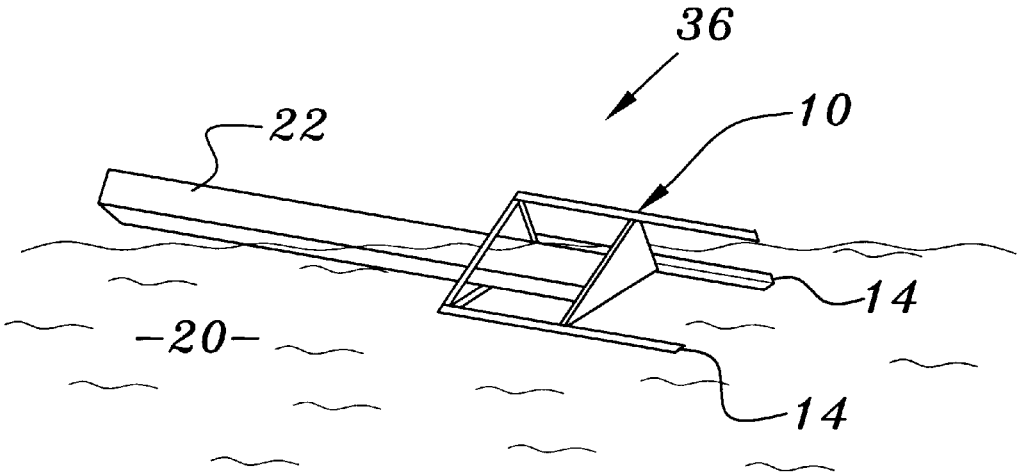
FIG. 3 is an elevational view of a buoyant dock leg having a third embodiment of the invention attached thereto, the dock leg and anchoring apparatus floating on a body of water.

The anchoring apparatus 10 is generally configured for use with a wooden dock leg 22 selected from conventional sizes of lumber or timber and may, for example, be a piece of pressure-treated 4×4 lumber that is long enough so that when one end is submerged and brought into contact with the bottom 18, the other end of the 4×4 protrudes upward above the waterline. The anchoring apparatus 10 comprises receiving means 24 usable for attaching the anchoring apparatus 10 to the dock leg 22. In a preferred embodiment the receiving means 24 comprises a post base 26 welded, or otherwise attached, to a top surface 28 of the base plate 12. In this embodiment the dock leg 22 is inserted into the post base 26 and nailed into place. The post base 26 is a conventional piece of construction hardware comprising a base portion adapted to be placed against an end of a piece of lumber and having two or more upstanding sidewalls. As is well known, post bases are available to fit a variety of conventional lumber and timber sizes. Those skilled in the art will recognize that other approaches to receiving and attaching a dock leg 22 to a base plate 12 could equally well be used. These other approaches comprise, but are not limited to forming one or more holes in the base plate and then fastening the dock leg 22 to the base plate with one or more fasteners 28, as depicted in FIG. 2.; or attaching one or more ell-shaped angle brackets to the base plate 12 and to the dock leg 22. Although it is expected that in most cases an installer will choose to use nails to attach the dock leg 22 to the post base 26, it will be recognized that many other fastening arrangements, including the use of screws or of a suitable construction adhesive, could be used.

In a preferred embodiment of the invention, the dock leg 22 fits a collar-like portion 30 of the anchoring apparatus 10. The collar-like portion 30 serves to aid in aligning the dock leg 22 perpendicular to the base plate 12 before attaching the leg to the plate, and also serves to prevent excessive lateral motion of the dock leg 22 after it has been attached to the base plate 12. Moreover, after the dock leg 22 has been installed by thrusting the anchor legs 14 into the bottom 18 of the body of water 20, the collar-like portion aids in preventing the dock leg from coming loose and tilting away from a preferred vertical orientation. It will be understood to those skilled in the art that the size of a preferred collar portion is selected to be large enough so that whatever lumber size has been chosen for the dock leg fits easily through the collar, and to be small enough so as to prohibit excessive tilting movement of the dock leg transverse to its axis.

A preferred embodiment of the anchoring apparatus 10, depicted in FIG. 1, is welded together from steel sheets and elongate members having an ell-shaped cross-section and generally referred to in the construction trades as "angle iron". The post base 26 and anchoring legs 14 are welded to the base plate 12, and additional angle iron is used to form a lattice 32 of elongate members that are welded together and attached to upper portions 34 of the anchoring legs 14 that extend upwardly from the base plate 12. Those skilled in the art will recognize that the elongate structural members used to form the anchoring apparatus could be made from a variety of materials having a variety of cross-sectional shapes. For example, the angle iron of FIG. 1 could be replaced with circular rod of the sort generally referred to as reinforcing rod, or "rebar".

The anchoring assembly 10 can be plated, painted, or otherwise coated to provide adequate corrosion resistance for long immersion. It will be noted by those skilled in the art that other materials, such as aluminum or stainless steel, could be used if increased corrosion resistance is required.

The anchoring apparatus 10 is preferably designed to be light enough that the combination 36 of the anchoring apparatus 10 and the wooden leg 22 will float. This choice provides for considerable ease of installation in that one can attach the anchoring apparatus 10 to the wooden dock leg 22 while on shore, float the combination 36 to a selected position where it is to be installed, turn the wooden dock leg 22 so that its axis is vertical and thrust the anchoring apparatus 10 into the bottom 18 of the body of water 20.

In order to help keep the anchoring legs 14 in place in the bottom 18, a preferred embodiment of the invention comprises a fluke or flukes 40 hingedly attached to one or more of the anchoring legs. In a preferred four-legged apparatus, a respective fluke is attached to each of two of the legs. As depicted in the drawing, this may be done by the use of pins 42 extending through the legs 14, where each pin extends through a bottom portion of the respective fluke. Each fluke 40 is thus configured so that it swings about the hinge point towards its respective leg 14 responsive to the leg 14 being thrust or driven into the bottom 18 of the body of water 20. After the fluke 40 has been pushed into the bottom 18, any attempt to pull the leg 14 out of the bottom 18 will cause the fluke 40 to swing outwardly of the respective anchor leg 14 so as to offer a dramatically increased resistance to the anchoring leg 14 being pulled out of the bottom 18.

A preferred fluke-mounting arrangement comprises a respective spring 44 adjacent each fluke, where the spring 44 is arranged to bias the fluke away from its associated leg 22. The strength of the spring is chosen so that when the apparatus 10 is thrust into a bottom 18, each fluke collapses against its leg. Once the apparatus 10 is in position, with the legs 22 embedded in the bottom 18, the spring tends to force the fluke outwardly from the leg.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

What is claimed is:

1. An apparatus for anchoring a dock leg to the bottom of a body of water, the apparatus comprising:

a base plate having a top surface and a periphery;

means for receiving the dock leg so that a bottom end of the dock leg is adjacent the top surface of the base plate;

at least three anchoring legs spaced out along the periphery of the base plate, each of the anchoring legs extending upwards and downwards from the base plate;

at least one fluke for resisting an upward force on the dock leg, the fluke attached to a respective anchoring leg at a point below the base plate and spaced apart therefrom; and a collar spaced apart above the base plate by the upwardly extending portions of the legs, the collar having a size selected to allow the dock leg to pass therethrough.

2. The apparatus of claim 1 wherein the base plate is rectangular, the apparatus comprising four anchoring legs attached to the rectangular base plate at respective corners thereof.

3. The apparatus of claim 1 wherein the dock leg is wooden and the means for receiving the dock leg comprises a post receiver.

4. An apparatus for anchoring a dock leg to the bottom of a body of water, the apparatus comprising:

a base plate having a top surface and a periphery;

means for receiving the dock leg so that a bottom end of the dock leg is adjacent the top surface of the base plate, and at least three anchoring legs for penetrating the bottom of the body of water, at least a portion of each of the anchoring legs depending from the base plate, at least one of the depending leg portions having a fluke hingedly attached thereto.

5. The apparatus of claim 4 further comprising a spring adapted to bias the fluke away from the leg.

6. A method of anchoring a buoyant dock leg to a bottom of a body of water, the method comprising the steps of:

a) attaching an anchoring apparatus to an end of the dock leg so that a base plate portion of the anchoring apparatus extends laterally outwardly from the dock leg, the anchoring apparatus comprising at least three bottom-penetrating anchoring legs extending longitudinally outwardly of the end of the dock leg when the dock leg is attached to the anchoring apparatus;

b) floating the buoyant dock leg having the anchoring apparatus attached thereto to a predetermined location; and c) turning the dock leg into a vertical orientation and thrusting the bottom-penetrating anchoring legs into the bottom of the body of water; and d) resisting an upwards force on the dock leg by means of a fluke attached to one of the anchoring legs, the fluke disposed below the base plate and spaced apart therefrom.

7. The method of claim 6 wherein the anchoring apparatus comprises a rectangular base plate having four bottom-penetrating anchoring legs extending from the four corners of the rectangular plate.

8. The method of claim 6 wherein the fluke is hingedly attached to the anchoring leg, and wherein the fluke moves about a hinge so as to be adjacent the anchoring leg during step c).

* * * * *